US008340543B2

(12) United States Patent
Ogiso et al.

(10) Patent No.: US 8,340,543 B2
(45) Date of Patent: Dec. 25, 2012

(54) TEMPERATURE CONTROL METHOD FOR FIXING DEVICE AND IMAGE FORMING APPARATUS INCORPORATING SAME

(75) Inventors: Toshio Ogiso, Osaka (JP); Shin Yamamoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 496 days.

(21) Appl. No.: 12/453,686

(22) Filed: May 19, 2009

(65) Prior Publication Data

US 2009/0290893 A1 Nov. 26, 2009

(30) Foreign Application Priority Data

May 20, 2008 (JP) ..... 2008-132372

(51) Int. Cl.
*G03G 15/20* (2006.01)

(52) U.S. Cl. ..... 399/69; 399/327; 219/216

(58) Field of Classification Search ..... 399/9, 33, 399/38, 67, 69, 320, 328–331, 335; 219/216, 219/244

See application file for complete search history.

(56) References Cited

U.S. PATENT DOCUMENTS

| | | | | |
|---|---|---|---|---|
| 4,998,121 | A * | 3/1991 | Koh et al. | 347/156 |
| 5,682,577 | A * | 10/1997 | Kiyoi | 399/69 |
| 5,701,554 | A * | 12/1997 | Tanaka et al. | 399/69 |
| 2004/0256372 | A1 * | 12/2004 | Yoshioka et al. | 219/216 |
| 2007/0140752 | A1 | 6/2007 | Yamamoto et al. | |
| 2007/0172278 | A1 | 7/2007 | Yamamoto | |
| 2008/0013993 | A1 | 1/2008 | Obata et al. | |
| 2008/0056783 | A1 | 3/2008 | Yamamoto et al. | |
| 2008/0069611 | A1 | 3/2008 | Obata et al. | |
| 2008/0193162 | A1 | 8/2008 | Yamazoe et al. | |

FOREIGN PATENT DOCUMENTS

| | | |
|---|---|---|
| JP | 3216386 | 8/2001 |
| JP | 2006-323093 | 11/2006 |

OTHER PUBLICATIONS

Abstract of JP 07-210028 published on Aug. 11, 1995.

* cited by examiner

*Primary Examiner* — Walter L Lindsay, Jr.
*Assistant Examiner* — Benjamin Schmitt
(74) *Attorney, Agent, or Firm* — Harness, Dickey & Pierce, P/L.C.

(57) ABSTRACT

A temperature control method for use in a fixing device that fixes a toner image on a recording sheet by passing the recording sheet through a fixing nip defined between a fixing member and a pressure member includes temperature detection, heater control, and duty control execution. The temperature detection detects a temperature of the fixing member with a temperature detector. The heater control controls operation of a heater of the fixing device by changing a duty thereof according to the detected temperature. The duty control execution executes a heater duty control to change a heater duty for a current control cycle discontinuously from that for a previous control cycle when the current control cycle precedes entry of the recording sheet into the fixing nip by a given period of time.

11 Claims, 5 Drawing Sheets

TEMPERATURE CONTROL METHOD FOR FIXING DEVICE AND IMAGE FORMING APPARATUS INCORPORATING SAME

CROSS-REFERENCE TO RELATED APPLICATIONS

The present patent application claims priority pursuant to 35 U.S.C.§119 from Japanese Patent Application No. 2008-132372 filed on May 20, 2008, the contents of which are hereby incorporated by reference herein in their entirety.

BACKGROUND OF THE INVENTION

1. Field of the Invention

The present invention relates to a temperature control method for use in a fixing device that fixes a toner image on a recording sheet by heating the recording sheet and an image forming apparatus incorporating such a temperature control method.

2. Discussion of the Background

In an image forming apparatus such as a copying machine, a printer, a facsimile machine or a multifunction device incorporating several of these functions, a fixing device for melting a toner image by heat and fixing it on a recording medium such as a sheet for printing or the like is often employed. FIG. 1 shows an example of a configuration of the fixing device.

As shown in FIG. 1, a fixing device 100 includes a fixing roller 110, a heating roller 120, a fixing belt 130, a pressure roller 140 and the like. The fixing belt 130 is extended between the fixing roller 110 and the heating roller 120. The heating roller 120 has a heater 150 inside. By having the heater 150 generate heat so as to heat the heating roller 120, the fixing belt 130 is also heated. Also, the pressure roller 140 is pressed against the fixing belt 130 at a position opposing the fixing roller 110 to form a fixing nip N therebetween. When a printing sheet P on which a toner image T has been transferred passes through the fixing nip N, the toner is melted and the image is fixed on the printing sheet P.

In order to ensure that the fixing device performs reliably, a temperature of the fixing belt must be maintained at a target temperature set in advance. Thus, a temperature detector 160 for detecting a temperature of the fixing belt 130 is disposed as shown in FIG. 1 for temperature control of the fixing belt 130.

As a temperature control method for the fixing belt, for example, an ON/OFF control method in which the heater 150 is turned on/off according to the temperature of the fixing belt 130 as measured by the temperature detector 160 is known. Specifically, if the temperature of the fixing belt is lower than a target temperature, a heater is turned on, while if the temperature of the fixing belt is higher than the target temperature, the heater is turned off.

However, employing only the ON/OFF temperature control method, the temperature of the fixing belt might deviate substantially from the target temperature. In order to decrease a temperature difference (also referred to as a temperature ripple) between the temperature of the fixing belt and the target temperature, an image forming apparatus shown in Japanese Unexamined Patent Application Publication No. 2006-323093, for example, executes PID control. PID control is a control method for optimizing a plurality of parameters according to a deviation between a detected temperature and a target temperature by combining proportional, integral, and differential with a control algorithm.

PID control is described referring to FIG. 2.

As an initial matter, if the temperature difference between a temperature $T_1$ of a fixing belt and a target temperature $T_0$ is large (e.g., 100 degrees or more), a heater duty D of a heater is increased for heat generation (proportional control). Thereafter, when the temperature $T_1$ of the fixing belt approaches the target temperature $T_0$, the heater duty D of the heater is decreased (differential control) so that the temperature $T_1$ of the fixing belt does not exceed (overshoot) the target temperature $T_0$. Then, in order to eliminate the difference between temperature $T_1$ of the fixing belt and the target temperature $T_0$, the heater duty D is adjusted (integral control).

When a toner image is fixed onto a printing sheet at a fixing nip, since the printing sheet draws heat from the fixing belt the temperature of the fixing belt decreases. At this time, in order to raise the lowered temperature of the fixing belt to a target temperature, a heater is caused to generate heat. However, it takes time for the heat generated by the heater to raise the temperature of the fixing belt, and as a result, the temperature of the fixing belt may not be maintained at an appropriate temperature and proper fixing might not occur.

Therefore, Japanese Patent No. 3216386, for example, discloses a temperature control method that compensates for heat drawn off by a printing sheet by electrifying a heater in advance, that is, before the printing sheet enters a fixing nip. Accordingly, responsiveness of the temperature control of a fixing belt is improved, and image quality is stabled.

However, a problem with the PID temperature control method described above is that, if the measured temperature of the fixing belt and the target temperature are close to each other, it is not possible to greatly increase the heater duty for heating. Consequently, increase of the heater duty is gentle even if the heater is electrified in advance before the entry. As a result, when the printing sheet enters the fixing nip when the temperature of the fixing belt and the target temperature are close to each other, the temperature of the fixing belt is rapidly lowered.

This phenomenon is illustrated in the graph shown in FIG. 2, which shows a temperature of the fixing belt, a target temperature of the fixing belt, and heater duty of a heater in the case of temperature control of the fixing belt by the related-art PID control. In FIG. 2, the area below the line $T_0$ (target temperature) but above the line $T_1$ (actual measured temperature) and indicated by the asterisk (*) is the shortfall created between the target temperature of the belt and the actual temperature of the belt due to this flaw in the PID temperature control method.

SUMMARY OF THE INVENTION

Exemplary aspects of the present invention are put forward in view of the above-described circumstances, and provide a novel temperature control method for use in a fixing device that prevents a reduction in temperature of a fixing belt caused by passage of a recording medium into a fixing nip.

Other exemplary aspects of the present invention provide a novel image forming apparatus that prevents a reduction in temperature of a fixing belt caused by passage of a recording medium into a fixing nip.

In one exemplary embodiment, the fixing device fixes a toner image on a recording sheet by passing the recording sheet through a fixing nip, and includes a fixing member and a heater. The fixing member is disposed pressed against a pressure roller to form the fixing nip therebetween. The heater heats the fixing member to a target temperature. The novel temperature control method includes temperature detection, heater control, and duty control execution. The temperature detection detects a temperature of the fixing member with a temperature detector. The heater control controls operation of the heater by changing a duty thereof according to the detected temperature. The duty control execution executes a heater duty control to change a heater duty for a current control cycle discontinuously from that for a previous control cycle when the current control cycle precedes entry of the recording sheet into the fixing nip by a given period of time.

In one exemplary embodiment, the image forming apparatus includes a fixing device, a temperature detector, and a heater controller. The fixing device fixes a toner image on a recording sheet by passing the recording sheet through a fixing nip, and includes a fixing member and a heater. The fixing member is disposed pressed against a pressure roller to form the fixing nip therebetween. The heater heats the fixing member to a target temperature. The temperature detector detects a temperature of the fixing member. The heater controller controls operation of the heater by changing a duty thereof according to the detected temperature. The heater controller executes a heater duty control to change a heater duty for a current control cycle discontinuously from that for a previous control cycle when the current control cycle precedes entry of the recording sheet into the fixing nip by a given period of time.

BRIEF DESCRIPTION OF THE DRAWINGS

A more complete appreciation of the disclosure and many of the attendant advantages thereof is readily obtained as the same becomes better understood by reference to the following detailed description when considered in connection with the accompanying drawings, wherein.

DETAILED DESCRIPTION OF PREFERRED EMBODIMENTS

Figure 1:
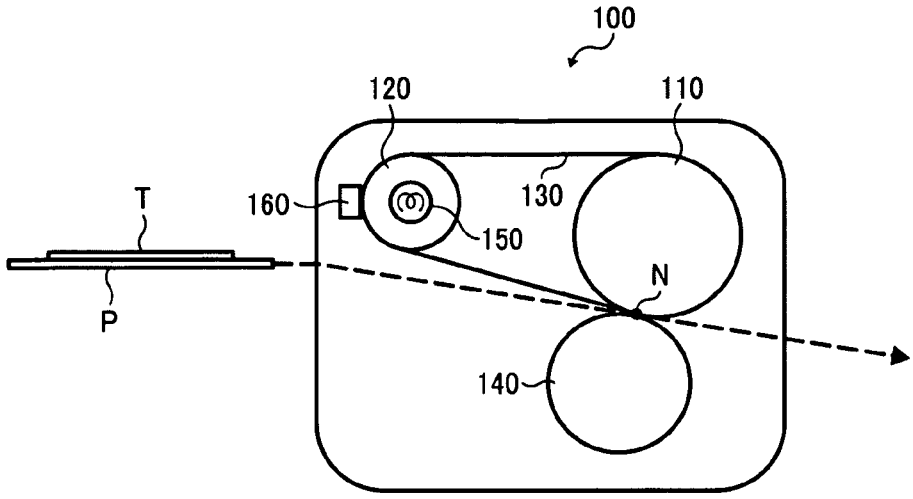
FIG. 1 BACKGROUND ART
FIG. 1 is a diagram illustrating an example of a configuration of a conventional fixing device.
Figure 2:
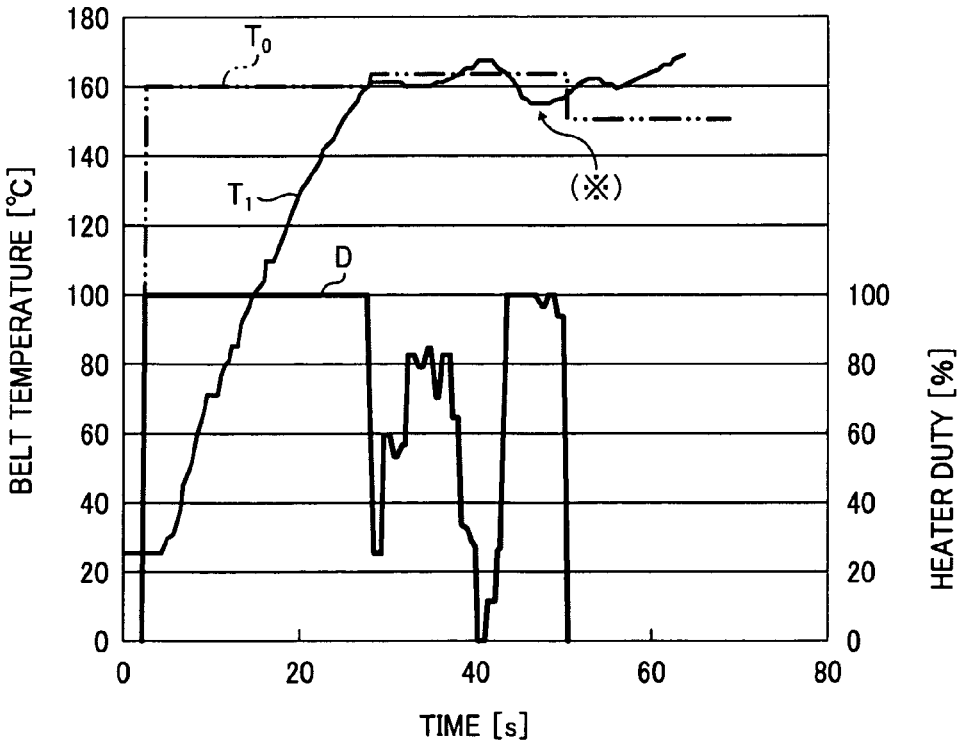
FIG. 2 BACKGROUND ART
FIG. 2 shows a temperature of a fixing belt, a target temperature of the fixing belt, and heater duty of a heater in the case of temperature control of the fixing belt by the related-art PID control.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, exemplary embodiments of the present patent application are described.

Figure 3:
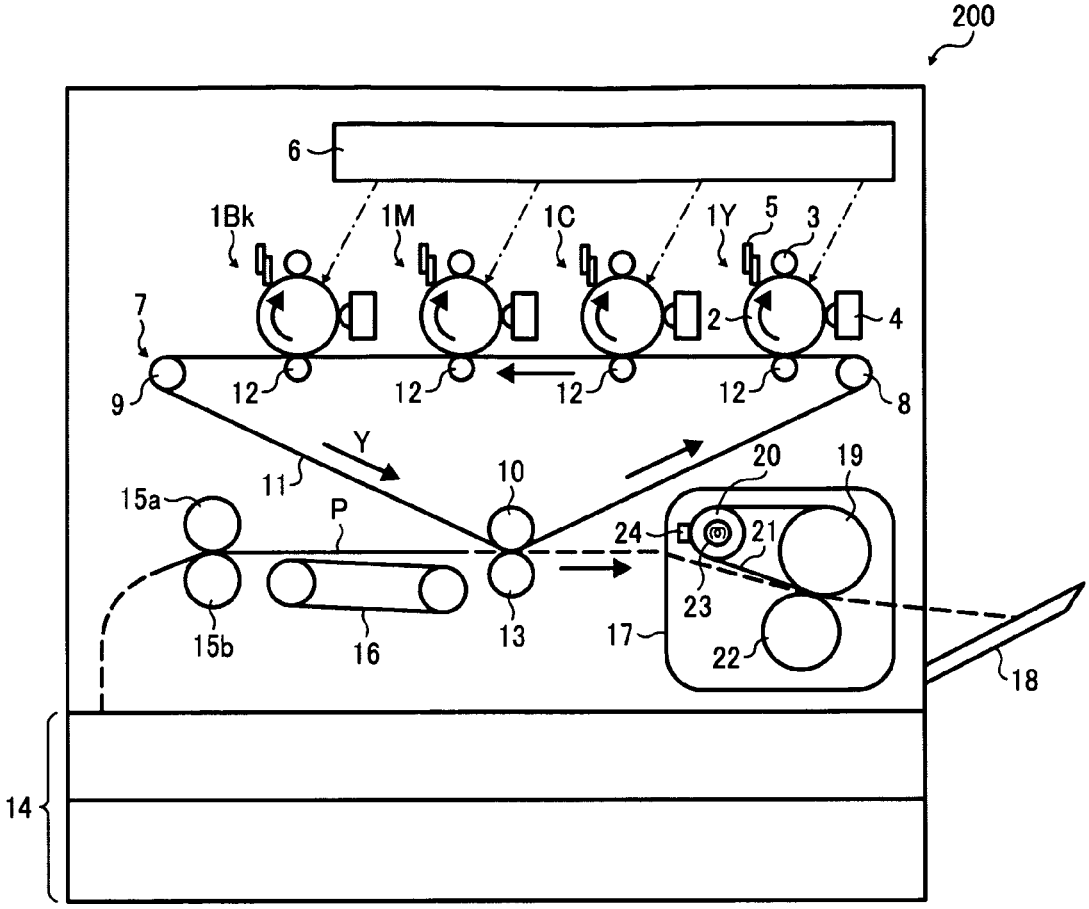
FIG. 3 is a diagram illustrating schematically a configuration of an image forming apparatus according to the present invention.

FIG. 3 is a diagram illustrating schematically a configuration of an embodiment of an image forming apparatus 200 according to the present invention. The image forming apparatus 200 of the present invention shown in FIG. 3 has four image forming portions 1Y, 1C, 1M, 1Bk for forming an image by developing agents in different colors of yellow, cyan, magenta, and black, respectively, corresponding to color separation components of a color image.

Each of the image forming portions 1Y, 1C, 1M, 1Bk has the same configuration, except that each contains toner of a color different from the others. Thus, a configuration of the image forming portion 1Y is described as an example.

The image forming portion 1Y is provided with a photoreceptor 2 as an image supporting body for supporting an electrostatic latent image, a charging device 3 for charging the surface of the photoreceptor 2, a development device 4 for forming a toner image on the surface of the photoreceptor 2, a cleaning device 5 for cleaning the surface of the photoreceptor 2, and the like. As the cleaning device 5, a cleaning blade, a cleaning roller, or a cleaning brush and the like can be employed, either singly or in combination.

Above the image forming portions 1Y, 1C, 1M, and 1Bk is disposed an exposure device 6 for forming an electrostatic latent image on the surface of the photoreceptor 2. Below the image forming portions 1Y, 1C, 1M, 1Bk, an intermediate transfer unit 7 is disposed. The intermediate transfer unit 7 has an intermediate transfer belt 11 extended among a plurality of extension rollers 8, 9, 10. The intermediate transfer belt 11 has at least one layer of an elastic coating formed on the surface of an endless belt base material, for example. The endless belt base material is constituted by a resin, rubber, or metal thin plate or the like. The elastic coating layer is constituted by a resin, rubber, elastomer, or the like.

Four primary transfer rollers 12 are pressed into contact with the four photoreceptors 2 through the intermediate transfer belt 11. As a result, the four photoreceptors 2 are pressed into contact with the outer peripheral face of the intermediate transfer belt 11, and a primary transfer nip is formed at a fixing nip between each of the photoreceptors 2 and the intermediate transfer belt 11. Also, a secondary transfer roller 13 is pressed into contact with one roller 10 of the above plurality of extension rollers through the intermediate belt 11. A secondary transfer nip is formed at a fixing nip where the secondary transfer roller 13 is pressed into contact with the outer peripheral face of the intermediate transfer belt 11.

At a lower part of the image forming apparatus 200, a recording medium supply portion 14 is disposed. The recording medium supply portion 14 is provided with a cassette capable of containing the recording media, which may be a stack of printing sheets, OHP films, or the like, a supply roller for feeding out the recording medium, and the like (not shown).

Between the recording medium supply portion 14 and the intermediate transfer unit 7, a pair of resist rollers 15*a*, 15*b*, a recording-medium feeding unit 16 having a feeding belt, and a fixing device 17 are disposed. On an outer wall of a main body of the image forming apparatus 200, a discharge tray 18 for stacking the recording media discharged to the outside is attached.

The fixing device 17 has a fixing roller 19, a pressure roller (pressure member) 22, a heating roller 20, and a fixing belt (fixing member) 21. The fixing roller 19 is constituted by an elastic layer made of silicon rubber or the like formed around a core metal constituted by aluminum, iron and the like. The pressure roller 22 is constituted by an elastic layer made of silicon rubber or the like provided around a hollow core metal constituted by aluminum, iron and the like and a release layer made of a fluorine resin layer or the like formed around it in order to ensure releasing property of toner. The heating roller 20 is constituted by a tubular body made of a highly heat-conductive material such as aluminum. The fixing belt 21 has a release layer made of a fluorine resin layer or the like formed on the surface of a belt base material such as polyimide or the like in order to ensure releasing property of the toner. Alternatively, an elastic layer made of silicon rubber or the like may be interposed between the belt base material and the release layer.

The fixing belt 21 is extended between the fixing roller 19 and the heating roller 20. The heating roller 20 has a heater 23 inside. By having the heater 23 generate heat so as to heat the heating roller 20, the fixing belt 21 is also heated.

The pressure roller 22 is pressed into contact with the outer peripheral face of the fixing belt 21 at a position opposing the fixing roller 19. A fixing nip is formed at a fixing nip where the pressure roller 22 and the fixing roller 21 press against each other through the fixing belt 21. It is to be noted that the configuration of the fixing device is not limited to that described in FIG. 3. Thus, for example, the fixing device may be so configured that the fixing belt is not provided but the fixing roller and the pressure roller press directly against each other.

Figure 4:
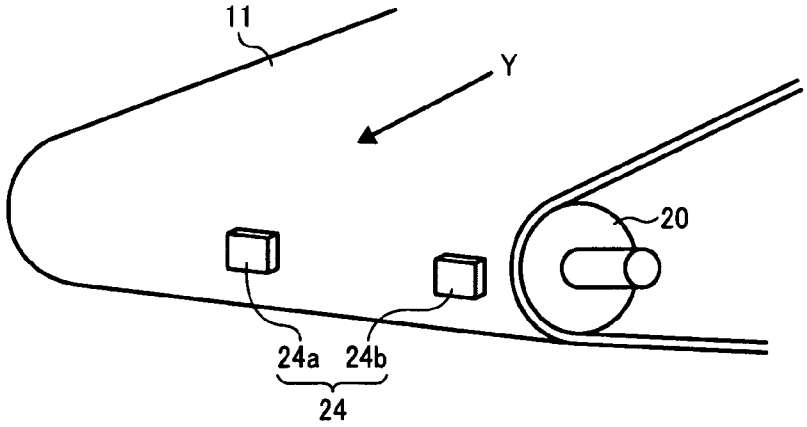
FIG. 4 is a perspective view illustrating a temperature detector provided on a fixing belt.

A temperature detector 24 is disposed on the outer periphery of the fixing belt 21. As shown in FIG. 4, if a direction orthogonally crossing the belt travelling direction shown by an arrow Y is referred to as a width direction of the fixing belt 21, the temperature detector 24 is provided with central temperature detector 24*a* disposed at a center part in the width direction of the fixing belt 21 and an peripheral temperature detector 24*b* disposed at an end part in the width direction of the fixing belt 21. The central temperature detector 24*a* and the peripheral temperature detector 24*b* are constituted by contact-type temperature detecting devices such as thermistors or the like, which detect temperature by contact with the fixing belt 21. Alternatively, the temperature detector 24*a*, 24*b* may be non-contact type temperature detecting devices such as thermopiles or the like, which can detect temperature without contact with the fixing belt 21.

Figure 5:
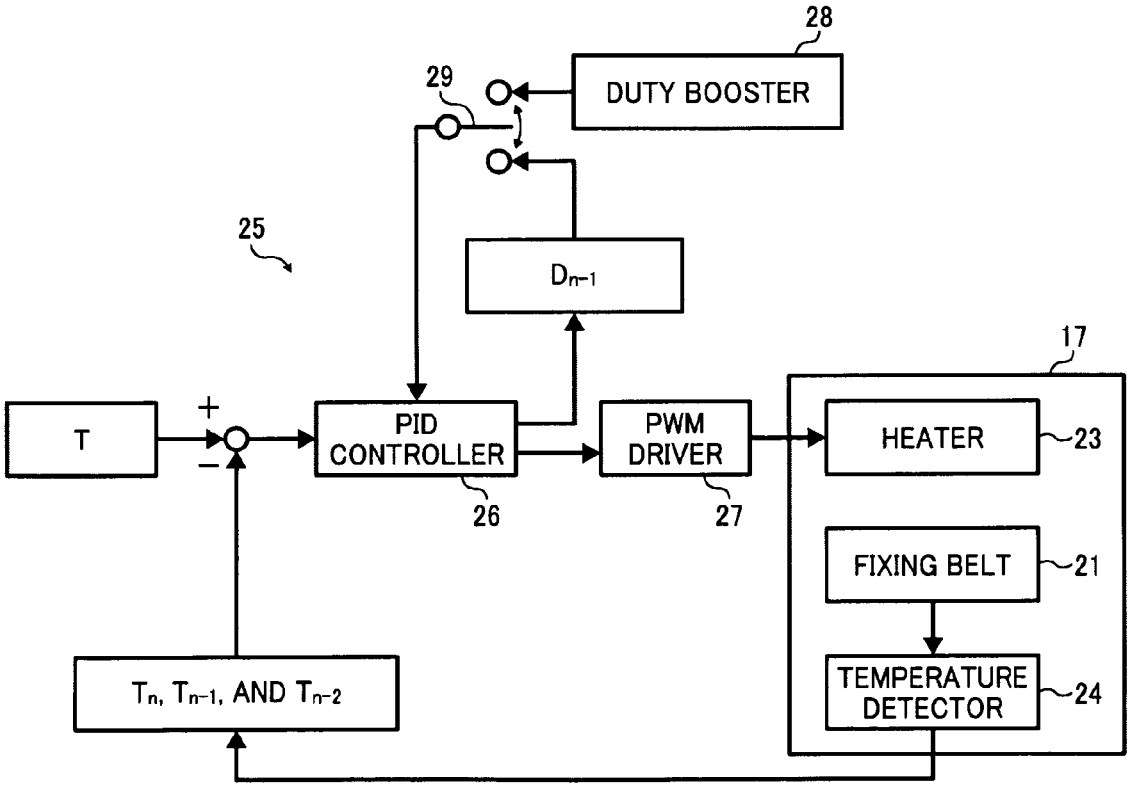
FIG. 5 is a block diagram of a heater controller.

FIG. 5 shows a block diagram of a heater controller 25 for controlling supply of electrical power to the heater 23. The heater controller 25 is provided with a PID controller 26 and a PWM driver 27. The PID controller 26 calculates activation time of the heater 23 for each predetermined control cycle (hereinafter referred to as heater duty) on the basis of a PID algorithm. The heart controller 25 is configured so that the heater 23 is activated through the PWM driver 27 on the basis of the heater duty calculated by the PID controller 26. For example, if the control cycle is t [s] and the heater duty is a [%], the heater 23 is activated only for t×a/100 [s].

Specifically, the PID controller 26 calculates the heater duty 23 on the basis of the PID algorithm shown in the following equation 1:

$$D_n = D_{n-1} + Kp*(T_{n-1} - T_n) + Ki*(T - T_n) + Kd*(2*T_{n-1} - T_n - T_{n-2}) \quad \text{[Equation 1]}$$

In the PID algorithm shown in the above equation 1, $D_n$ is the heater duty calculated in the current control cycle, $D_{n-1}$ is the heater duty calculated in the control cycle preceding the current control cycle, T is a target temperature of the fixing belt, $T_n$ is a temperature of the fixing belt detected in the current control cycle, $T_{n-1}$ is a temperature of the fixing belt detected in the control cycle preceding the current control cycle, $T_{n-2}$ is a temperature of the fixing belt detected in the control cycle prior to the preceding one, Kp is a proportional gain, Ki is an integral gain, and Kd is a differential gain. Hereinafter the heater duty $D_{n-1}$ calculated in the previous control cycle is referred to as the preceding heater duty. Also, the temperature $T_{n-1}$ of the fixing belt detected in the preceding control cycle is referred to as the previous temperature, and the temperature $T_{n-2}$ of the fixing belt detected in the control cycle prior to the preceding one is referred to as the detected temperature prior to the previous one.

The image forming apparatus 200 of the present invention executes control so that mainly a temperature at the center part in the width direction of the fixing belt 21 becomes the target temperature for favorable fixing. Therefore, the temperature of the fixing belt in the above PID algorithm is the temperature at the center part in the width direction of the fixing belt 21, and the above target temperature is the target temperature at the center part in the width direction of the fixing belt 21. It is to be noted that although the PID algorithm is set as the above equation 1 herein, it is not limited to this calculation equation.

The heater controller 25 is provided with the heater duty booster 28. The heater duty booster 28 obtains a value of the heater duty larger than the heater duty calculated on the basis of the above PID algorithm. For example, the heater duty booster 28 is configured to substitute 100[%] instead of the previous heater duty $D_{n-1}$ in the above PID algorithm. Also, it is configured with a control switch 29 to enable selective switching between control by the heater duty booster 28 (heater duty control) and the usual heater duty control executing the PID control not by the heater duty booster 28.

Basic operation of the above image forming apparatus 200 is described below referring to FIG. 3.

First, an image forming operation is described using one image forming portion 1Y as an example.

The surface of the photoreceptor 2 is charged with a uniform high potential by the charging device 3. A laser beam irradiates the surface of the photoreceptor 2 from the exposure device 6 on the basis of image data, and the potential on the irradiated portion is lowered so that an electrostatic latent image is formed. On the portion on the surface of the photoreceptor 2 where the electrostatic latent image is formed, a toner charged by the development device 4 is electrostatically transferred so that a visible yellow toner image is formed thereat.

A constant-voltage or constant-current controlled voltage of a polarity opposite to the charging polarity of the toner is applied to the primary transfer roller 12. As a result, a transfer electric field is formed at the primary transfer nip between the primary transfer roller 12 and the photoreceptor 2. At the primary transfer nip, the toner image on the rotating photoreceptor 2 is transferred to the intermediate transfer belt 11 travelling in the direction of the arrow Y in FIG. 3.

Similarly, a toner image is formed on the photoreceptor 2 in each of the other image forming portions 1C, 1M, 1Bk and transferred onto the intermediate transfer belt 11, so that the toner images are superimposed with each other. As a result, a synthetic toner image in which the toner images in four colors are superimposed is formed on the intermediate transfer belt 11.

Each of the cleaning device 5 removes remaining toner adhering to the surface of the photoreceptor 2 having going through the primary transfer process. After that, any charge remaining on the photoreceptor 2 is removed by a destaticizing device such as a destaticizing lamp or the like, not shown.

On the other hand, the supply roller of the recording medium supply portion 14 is rotated so as to feed out a recording medium P. The recording medium P fed out of the recording medium supply portion 14 is stopped once by the resist rollers 15*a*, 15*b*.

After the synthetic toner image is formed on the intermediate transfer belt 11 as mentioned above, the driving of the resist rollers 15*a*, 15*b* is resumed, and the recording medium P is fed to the secondary transfer nip between the secondary transfer roller 13 and the roller 10 in synchrony with the synthetic toner image on the intermediate transfer belt 11. Then, the synthetic toner image on the intermediate transfer belt 11 is transferred onto the recording medium P fed to the secondary transfer nip.

The recording medium P onto which the synthetic toner image has been transferred is fed to the fixing device 17. More specifically, the recording medium P is fed to the fixing nip formed between the fixing roller 19 and the pressure roller 22. While the recording medium P passes through the fixing nip, the toner constituting the synthetic toner image is melted and fixed on the recording medium P. After that, the recording medium P on which the synthetic toner image has been fixed is discharged onto the discharge tray 18 and stacked.

A description is now given of a temperature control method for the fixing device according to the present invention.

Figure 6:
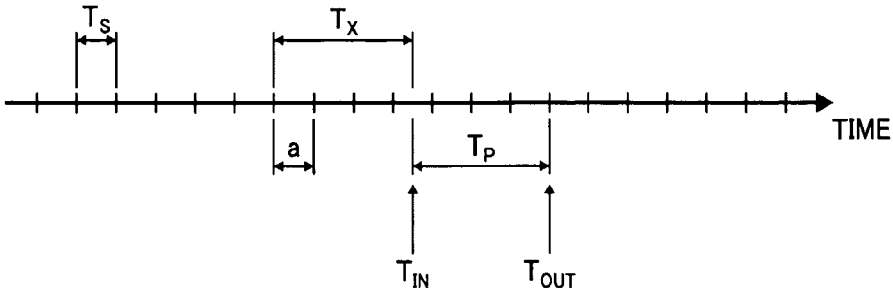
FIG. 6 is a timing chart illustrating a first embodiment of a temperature control method according to the present invention.

FIG. 6 is a timing chart illustrating a first embodiment of the temperature control method according to the present invention. In FIG. 6, $T_{IN}$ indicates timing when the recording medium enters the fixing nip, and $T_{OUT}$ indicates timing when the recording medium exits the fixing nip. That is, a time $T_p$ from $T_{IN}$ to $T_{OUT}$ in FIG. 6 shows a passage time during which a single sheet of recording medium passes through the fixing nip.

As shown in FIG. 6, the heater duty is calculated by the heater controller for a control cycle $T_s$ determined in advance, for example 200 msec, and the heater is activated on the basis of the calculated heater duty. Essentially, the heater controller executes the usual heater duty control on the basis of the above PIC calculation equation. More specifically, by the PID controller 26 shown in FIG. 5, the current heater duty $D_n$ is calculated by substituting the current temperature $T_n$, the previous temperature $T_{n-1}$, the temperature $T_{n-2}$ prior to the previous one, the target temperature T, and the previous heater duty $D_{n-1}$ obtained from the temperature detector 24 in the PID algorithm in each control cycle $T_s$. On the basis of the calculated heater duty $D_n$, the temperature of the fixing belt (center part in the width direction) is brought close to the target temperature T by controlling the activation time of the heater.

If a printing request is made from a user to the image forming apparatus 200, the recording medium on which the image has been transferred is fed to the fixing device. In a control cycle a prior to the entry of the recording medium fed to the fixing device into the fixing nip by a predetermined time Tx, the heater duty control is executed. The heater duty control is enabled when the heater duty booster 28 is connected to the PID controller 26 by switching the control switch 29 shown in FIG. 5. By the heater duty booster 28, 100[%] is substituted for the previous heater duty $D_{n-1}$ in the above PID algorithm. Also, the current temperature $T_n$, the previous temperature $T_{n-1}$ the temperature $T_{n-2}$ prior to the previous one, and the target temperature T are substituted in the PID algorithm so as to calculate the current heater duty $D_n$. With the current heater duty $D_n$ calculated by the heater duty control, a value larger than that of the heater duty calculated by the usual heater duty control (that is, not using the heater duty booster 28) can be calculated. After the heater duty control is executed, the control switch 29 is switched so as to return to the usual heater duty control.

Figure 7:
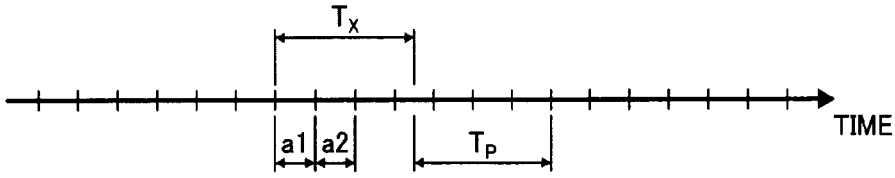
FIG. 7 is a timing chart illustrating a second embodiment of the temperature control method according to the present invention.

FIG. 7 is a timing chart illustrating a second embodiment of the temperature control method according to the present invention. As shown in FIG. 7, in the second embodiment, the heater duty control is executed in the control cycle a1 the predetermined time Tx prior to the entry of the recording medium into the fixing nip and in a control cycle a2 subsequent to the control cycle a1. Since the heater duty control at this time is the same as the above-mentioned heater duty control, the description is omitted. In this embodiment, the heater duty control is executed twice continuously from the control cycle the predetermined time Tx prior to the entry of the recording medium into the fixing nip, but the control may be executed three times or more.

Figure 8:
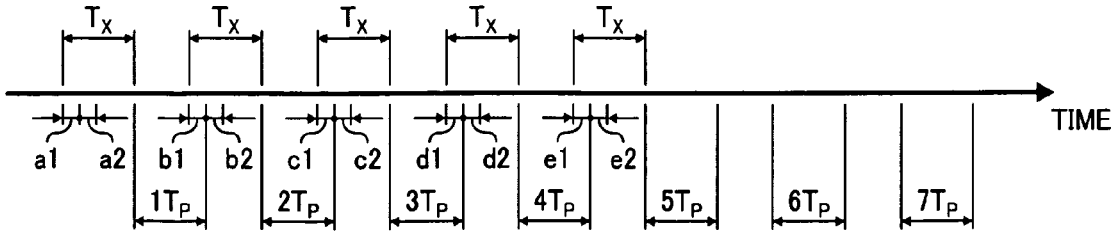
FIG. 8 is a timing chart illustrating a third embodiment of the temperature control method according to the present invention.

FIG. 8 is a timing chart illustrating a third embodiment of the temperature control method according to the present invention. This embodiment shows an example of the temperature control method of the fixing device when a continuous image forming operation is carried out. A "continuous image forming operation" is an operation in which an image is continuously formed on a plurality of recording media according to a single printing request (a single job) initiated by the user. In this embodiment, image formation on 7 pieces of the recording media, for example, is requested, and the image forming apparatus 200, having received the request, transfers the image on the 7 pieces of the recording media and then sequentially feeds the recording media into the fixing device.

1Tp to 7Tp shown in FIG. 8 show passage time during which the 7 pieces of the recording media sequentially pass through the fixing nip. In each of the control cycles a1, a2, b1, b2, . . . e1, e2 shown in the figure, the above-mentioned heater duty control is executed. That is, for the first to fifth recording media passing through the fixing nip in these 7 pieces of the recording media, the heater duty control is executed twice continuously from the control cycle the predetermined time Tx prior to entry of each recording medium into the fixing nip. On the other hand, the heater duty control is not executed for the sixth and seventh recording media passing through the fixing nip. As mentioned above, in the embodiment shown in FIG. 8, the heater duty control is not executed from the middle of the plurality of recording media continuously passing through the fixing nip onward. The number of recording media continuously passing through the fixing nip and from what number in the recording media passing through the fixing nip execution of the heater duty control is stopped can be changed as appropriate.

Figure 9:
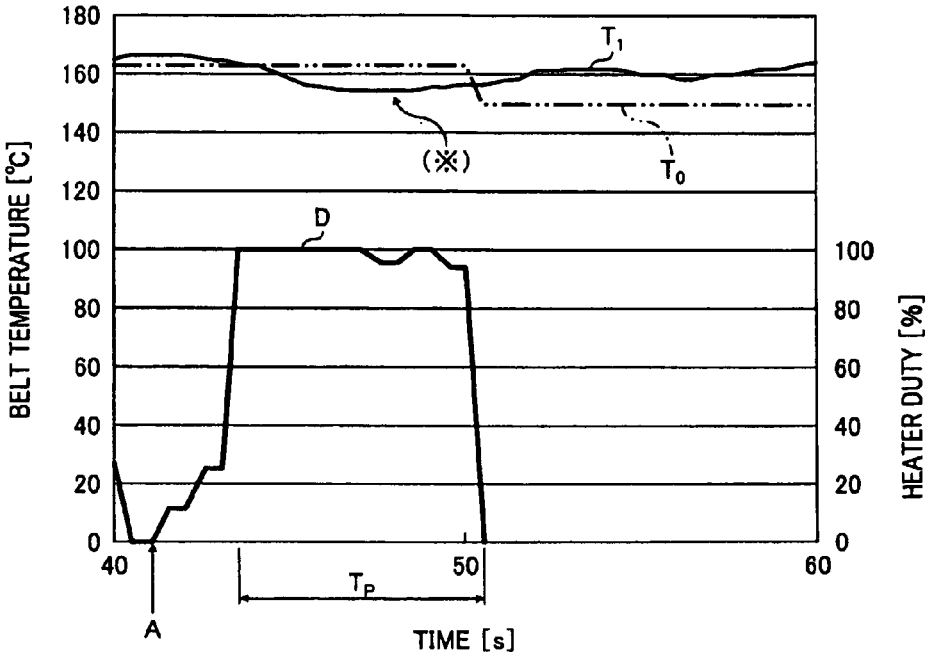
BACKGROUND ART FIG. 9
FIG. 9 is a graph showing a temperature of the fixing belt, a target temperature of the fixing belt, and heater duty of a heater in the case of temperature control of the fixing belt by the related-art PID control.
Figure 10:
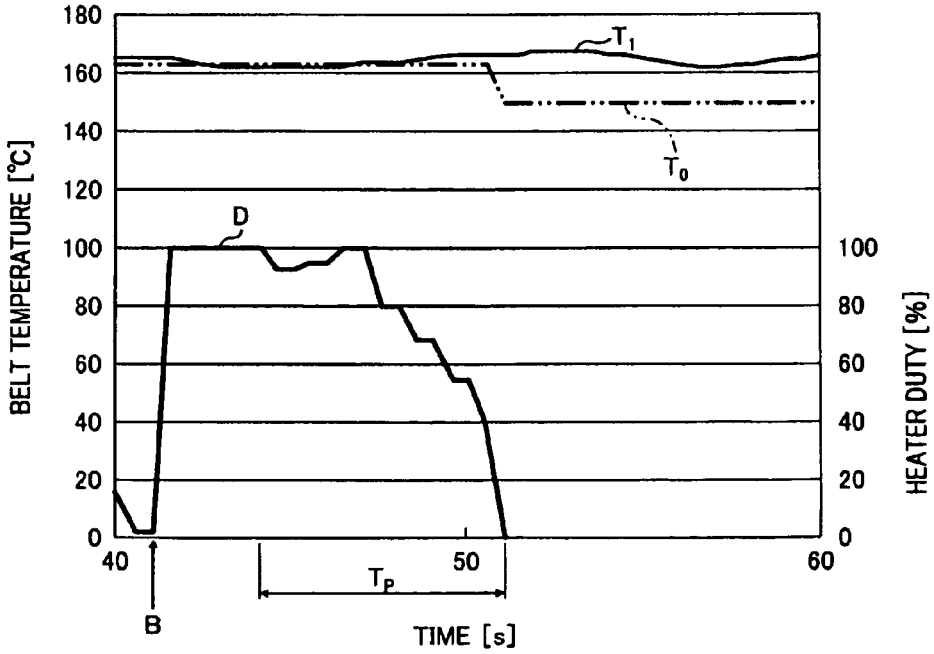
FIG. 10 is a graph showing a temperature of the fixing belt, a target temperature of the fixing belt, and heater duty of a heater in the case of temperature control of the fixing belt by the control of the present invention.

In each of the above embodiments according to the present invention, with the heater duty control, the heater can be activated with a larger heater duty value as compared with that of the usual heater duty control. This is described referring to FIGS. 9 and 10. FIG. 9 shows an actual measured temperature $T_1$ of the fixing belt when the temperature control of the fixing belt is executed by the related-art PID control, a target temperature $T_0$ of the fixing belt, and the heater duty D of the heater. FIG. 10 shows the actual measured temperature $T_1$ of the fixing belt when the temperature control of the fixing belt is executed by the heater duty control of the present invention, the target temperature $T_0$ of the fixing belt, and the heater duty D of the heater. In the embodiment shown in FIGS. 9 and 10, Tp denotes time during which 3 pieces of recording media continuously pass through the fixing nip.

In FIG. 9, in the related-art PID control, the heater duty is raised from a point in time A. In FIG. 10, in the control of the present invention, the heater duty control is executed at a point in time B so as to raise the heater duty. When a rising degree of the heater duty in FIG. 9 and a rising degree of the heater duty in FIG. 10 are compared, it can be seen that, in the control of the present invention with the heater duty control executed, the heater duty rises more rapidly than in the related-art PID control. That is, the related-art PID control shown in FIG. 9 largely changes the heater duty in a continuous manner, but the control of the present invention shown in FIG. 10 largely changes the heater duty in a discontinuous manner (with respect to the heater duty in the preceding control cycle) by executing the heater duty control.

The reason for this difference in rate of change of the heater duty is that, in the related-art PID control, since the temperature $T_1$ of the fixing belt is close to the target temperature $T_0$ at the point in time A in FIG. 9, a large value is not substituted for the previous heater duty $D_{n-1}$ in the PID algorithm shown in the equation 1. Thus, the calculated heater duty becomes a small value, and the rising degree of the heater duty becomes relatively gentle. Therefore, the related-art PID control cannot have the heater strongly generate heat before the recording medium enters the fixing nip, and a sufficient heat quantity cannot be supplied to the fixing belt. As a result, fixing belt is deprived of heat by the recording medium passing through the fixing nip thereafter, causing a consequent drop in the temperature $T_1$ of the fixing nip as indicated by the asterisk (*) in FIG. 9.

By contrast, in the heater duty control of the present invention, even if the temperature $T_1$ of the fixing nip is close to the target temperature $T_0$ at the point in time B in FIG. 10, a large value such as 100[%] or the like can be substituted as a value to be substituted for the previous heater duty $D_{n-1}$ in the PID algorithm shown in the above equation 1. As a result, the heater duty can be calculated with a large value, and the heater duty can be rapidly raised. Therefore, since the heater is made to strongly generate heat and a sufficient heat quantity can be supplied to the fixing nip, the loss of heat to the recording medium passing through the fixing nip can be offset. As a result, when the recording medium passes through the fixing nip, a drop in the temperature $T_1$ of the fixing belt can be suppressed.

In addition, it is to be noted that there is a time lag till the heat of the heater reaches the fixing belt. Thus, in the temperature control method of the present invention, the heater duty control of the heater is executed in the control cycle the predetermined time Tx prior to entry of the recording medium into the fixing nip. As a result, heat can be supplied to the fixing belt when the heat of the fixing belt is deprived of by the recording medium.

In the above embodiments, the heater duty control is executed by substituting 100[%] for the previous heater duty $D_{n-1}$ in the above PID algorithm. However, the value to be substituted is not limited to 100[%]. Thus, if a value larger than the heater duty calculated by the above usual heater duty control can be calculated, the value to be substituted may be 95[%] or 90[%], for example.

The predetermined time Tx is set on the basis of the thermal responsiveness of the fixing device. The thermal responsiveness of the fixing device is determined by the material of the fixing device, the heating capacity of the heater, and the like. For example, the predetermined time Tx may be set to a time from start of activation of the heater until the temperature of the fixing belt is raised by the activation of the heater. In each of the embodiments described above, an optimal value of the above predetermined time Tx for minimizing a temperature difference (temperature ripple) between the temperature of the fixing belt and the target temperature is set at 3 seconds. By setting the predetermined time Tx on the basis of the thermal responsiveness of the fixing device, even if the fixing speed or the like is different, there is no need to change the predetermined time Tx. Thus, the temperature control of the fixing device can be executed more easily.

For example, if the recording medium is a printing sheet, the heat absorbed from the fixing belt by the printing sheet when the printing sheet passes through the fixing nip is different depending on the mass of the printing sheet. Specifically, the smaller the mass of the printing sheet, the smaller the absorbed heat quantity, while the larger the mass of the printing sheet, the larger the absorbed heat quantity. If the absorbed heat quantity is large when the printing sheet passes through the fixing nip, the number of times the heater duty control is executed must be increased accordingly. Thus, as in the second embodiment of the present invention shown in FIG. 7, by executing the heater duty control several times continuously from the predetermined time Tx prior to entry of the recording medium into the fixing nip, the heat quantity supplied to the fixing belt can be increased.

On the other hand, if the absorbed heat quantity is small when the printing sheet passes through the fixing nip, the number of times the heater duty control need to be executed may be small. Therefore, preferably, the number of times the heater duty control is executed is increased the larger the mass of the printing sheet passing through the fixing nip. Conversely, preferably, the number of times the heater duty control is executed is decreased the smaller the mass of the printing sheet passing through the fixing nip. Moreover, the larger the area or the mass (weight) per unit area of the printing sheet, the larger the mass of the printing sheet becomes. Thus, the larger the area or the mass per unit area of the printing sheet, the greater the number of times the heater duty control is executed. Conversely, the smaller the area or the mass per unit area of the printing sheet, the fewer the number of times the heater duty control is executed.

An example of the number of times the heater duty control times is executed as determined by the sheet size (sheet area or sheet length) and the mass (weight) of the printing sheet is shown in the following table 1. By preparing such a table in advance, the number of times the heater duty control is executed may be changed according to the printing sheet in use.

TABLE 1

| | | Sheet size | | | |
|---|---|---|---|---|---|
| | | A5 | A4 | Legal | Lengthy |
| Mass (weight) per unit area | 65 g/m$^2$ or less | 1 | 2 | 2 | 3 |
| | 66 g/m$^2$ to 74 g/m$^2$ | 1 | 2 | 2 | 3 |
| | 75 g/m$^2$ to 90 g/m$^2$ | 1 | 2 | 3 | 4 |
| | 91 g/m$^2$ to 160 g/m$^2$ | 2 | 3 | 4 | 6 |
| | 161 g/m$^2$ to 220 g/m$^2$ | 3 | 4 | 5 | 7 |

In addition, since the heat quantity absorbed when the recording medium passes through the fixing nip is different depending on the type of material constituting the recording medium (paper, OHP film and the like), preferably the number of times the heater duty control is executed is changed according to the type of recording medium material.

As described using FIG. 4, the image forming apparatus 200 according to the present invention is configured to detect a temperature at the center part in the width direction of the fixing belt 21 and the end part in the width direction of the fixing belt 21 with the central temperature detector 24*a* and the peripheral temperature detector 24*b*, respectively. During a continuous image forming operation, if the heater duty control is executed in accordance with each recording medium passing through the fixing nip, since the heat supplied by the heater and the heat drawn off by the recording medium are substantially equal at the center part in the width direction of the fixing belt, the temperature at the center part in the width direction of the fixing belt does not deviate substantially from the target temperature. On the other hand, at the end part in the width direction of the fixing belt, since the heat drawn off by the recording medium is small, the temperature of the fixing belt 21 thereat tends to rise. If the temperature at the end part in the width direction of the fixing belt rises too much, there is a risk that defective fixing occurs in the form of hot offset or the like. Thus, as in the third embodiment illustrated shown in the above FIG. 8, by not executing the heater duty control for the recording media passing through the fixing nip in the predetermined run and thereafter, an excessive increase in the temperature at the end part in the width direction of the fixing belt can be suppressed.

Further, in order to prevent defective fixing such as hot offset or the like, a threshold value of the temperature at the end part in the width direction of the fixing belt may be set in advance. In that case, if the temperature at the end part in the width direction of the fixing belt is not more than the threshold value, the heater duty control is executed in the control cycle the predetermined time Tx prior to entry of the recording medium into the fixing nip, whereas if the temperature at the end part in the width direction of the fixing belt exceeds the threshold value, the heater duty control is not executed. As a result, at the end part in the width direction of the fixing belt, any excessive temperature rise that might cause defective fixing such as hot offset or the like can be suppressed.

Finally, by adjusting the target temperature at the center part in the width direction of the fixing belt, the temperature at the end part in the width direction of the fixing belt can be adjusted. Specifically, control is executed such that, if the temperature at the end part in the width direction of the fixing belt exceeds a predetermined upper limit value, the target temperature at the center part in the width direction of the fixing belt is lowered, whereas if the temperature at the end part in the width direction of the fixing belt falls below a predetermined lower limit value, the target temperature at the center part in the width direction of the fixing belt is raised.

In a continuous image forming operation, it is also possible to suppress the temperature rise at the end part in the width direction of the fixing belt by interrupting printing in the middle or by lengthening the interval between successive passages of recording media through the fixing nip.

Numerous additional modifications and variations of the present invention are possible in light of the above teachings. It is therefore to be understood that, within the scope of the appended claims, the disclosure of this patent specification may be practiced otherwise than as specifically described herein. For example, the heater duty booster may obtain the heater duty without using the PID algorithm shown in the equation 1, and the temperature control method according to the present invention can be applied to the fixing device for calculating the heater duty using an equation other than the PID algorithm described above.

What is claimed is:

1. A temperature control method for use in a fixing device that fixes a toner image on a recording sheet by passing the recording sheet through a fixing nip, the fixing device including:

a fixing member disposed to indirectly press against a pressure roller to form the fixing nip therebetween; and a heater to heat the fixing member to a target temperature, the method comprising:

detecting a temperature of the fixing member with a temperature detector;

controlling operation of the heater by changing a duty thereof according to the detected temperature, wherein controlling the heater operation includes calculating a calculation equation to obtain each heater duty; and executing a heater duty control to change a heater duty for a current control cycle discontinuously from that for a previous control cycle when the current control cycle precedes entry of the recording sheet into the fixing nip by a given period of time, wherein the executing of the heater duty control causes the heater duty for the current control cycle to exceed a value obtained from the calculation equation when the current control cycle precedes entry of the recording sheet into the fixing nip by the given period of time, wherein the calculation equation comprises a proportion-integral-derivative (PID) algorithm given by:

$$D_n=D_{n-1}+Kp*(T_{n-1}-T_n)+Ki*(T-T_n)+Kd*(2*T_{n-1}-T_n-T_{n-2})$$

where $D_n$ is the heater duty for a n-th control cycle, $D_{n-1}$ is the heater duty for a (n−1)th control cycle, T is the target temperature, $T_n$ is a temperature of the fixing member detected for the n-th current control cycle, $T_{n-1}$ is a temperature of the fixing member detected for the (n−1) th control cycle, $T_{n-2}$ is a temperature of the fixing member detected for a (n−2)th control cycle, Kp is a proportional gain, Ki is an integral gain, and Kd is a differential gain, and the heater duty control obtains the heater duty for the current control cycle by substituting a given corrective value greater than the actual heater duty for the previous control cycle for $D_{n-1}$ in the PID algorithm.

2. The temperature control method according to claim 1, wherein when p recording sheets successively pass the fixing nip, the heater duty control is executed only in response to first through q-th recording sheets entering the fixing nip, and not in response to (q+1)th through p-th recording sheets entering the fixing nip.

3. The temperature control method according to claim 1, wherein the heater duty control is executed for multiple control cycles starting from a control cycle preceding entry of the recording sheet into the fixing nip by the given period of time.

4. The temperature control method according to claim 1, wherein a number of times heater duty control is executed increases in response to an increase in an amount of heat absorbed from the fixing member by the recording sheet passing through the fixing nip, and decreases in response to a decrease in an amount of heat absorbed from the fixing member by the recording sheet passing through the fixing nip.

5. The temperature control method according to claim 1, wherein a number of times heater duty control is executed increases in response to an increase in an area of the recording sheet passing through the fixing nip, and decreases in response to a decrease in an area of the recording sheet passing through the fixing nip.

6. The temperature control method according to claim 1, wherein a number of times heater duty control is executed increases in response to an increase in a mass per unit area of the recording sheet passing through the fixing nip, and decreases in response to a decrease in a mass per unit area of the recording sheet passing through the fixing nip.

7. The temperature control method according to claim 1, the method further comprising:

detecting a central temperature at a center of the fixing member in a width direction; and detecting a peripheral temperature at an end of the fixing member in the width direction, wherein controlling the heater operation adjusts the central temperature to a target temperature, and executing the heater duty control is done only with the peripheral temperature falling below a given threshold, and not with the peripheral temperature exceeding the given threshold.

8. The temperature control method according to claim 1, wherein the given period of time is set according to a thermal responsiveness of the fixing device.

9. The temperature control method according to claim 1, wherein executing the heater duty control to change the heater duty includes starting a new control cycle.

10. An image forming apparatus comprising:

a fixing device to fix a toner image on a recording sheet by passing the recording sheet through a fixing nip, the fixing device including:

a fixing member disposed to indirectly press against a pressure roller to form the fixing nip therebetween; and a heater to heat the fixing member to a target temperature;

a temperature detector to detect a temperature of the fixing member; and a heater controller to control operation of the heater by changing a duty thereof according to the detected temperature to heat the fixing member, wherein the heater controller executes a heater duty control to change a heater duty for a current control cycle discontinuously from that for a previous control cycle when the current control cycle precedes entry of the recording sheet into the fixing nip by a given period of time, wherein the heater controller calculates a calculation equation to obtain each heater duty, and includes a duty booster to cause the heater duty for the current control cycle to exceed a value obtained from the calculation equation when the current control cycle precedes entry of the recording sheet into the fixing nip by the given period of time; and, wherein the calculation equation comprises a proportion-integral-derivative (PID) algorithm given by:

$$D_n = D_{n-1} + Kp*(T_{n-1} - T_n) + Ki*(T - T_n) + Kd*(2*T_{n-1} - T_n - T_{n-2})$$

where $D_n$ is the heater duty for a n-th control cycle, $D_{n-1}$ is the heater duty for a (n−1)th control cycle, T is the target temperature, $T_n$ is a temperature of the fixing member detected for the n-th current control cycle, $T_{n-1}$ is a temperature of the fixing member detected for the (n−1) th control cycle, $T_{n-2}$ is a temperature of the fixing member detected for a (n−2)th control cycle, Kp is a proportional gain, Ki is an integral gain, and Kd is a differential gain, and the duty booster obtains the heater duty for the current control cycle by substituting a given corrective value greater than the actual heater duty for the previous control cycle for $D_{n-1}$ in the PID algorithm.

11. The image forming apparatus according to claim 10, wherein the heater controller executes the heater duty control, including starting a new control cycle.

* * * * *